United States Patent [19]

Breslow et al.

[11] 4,076,006

[45] Feb. 28, 1978

[54] TOY ROCKET WITH PNEUMATIC LAUNCHER

[75] Inventors: Jeffrey D. Breslow, Highland Park; Eugene Jaworski, Park Ridge, both of Ill.

[73] Assignee: Marvin Glass & Associates, Chicago, Ill.

[21] Appl. No.: 709,651

[22] Filed: Jul. 29, 1976

Related U.S. Application Data

[63] Continuation-in-part of Ser. No. 623,756, Oct. 20, 1975, abandoned.

[51] Int. Cl.[2] ..... F41B 11/00

[52] U.S. Cl. ..... 124/64; 46/74 B; 46/44

[58] Field of Search ..... 124/11 R, 12, 64; 46/74 B, 81, 44, 209

[56] References Cited

U.S. PATENT DOCUMENTS

| | | | |
|---|---|---|---|
| 650,633 | 5/1900 | Cooper et al. | 124/11 R |
| 1,033,094 | 7/1912 | Fuda | 124/11 R |
| 2,993,297 | 7/1961 | Bednar et al. | 46/74 B |
| 3,301,246 | 1/1967 | Wolfe | 46/74 B |

FOREIGN PATENT DOCUMENTS

| | | | |
|---|---|---|---|
| 1,260,116 | 3/1961 | France | 124/12 |
| 2,038,610 | 2/1972 | Germany | 46/44 |
| 320,738 | 9/1934 | Italy | 124/11 R |
| 474,435 | 9/1952 | Italy | 124/11 R |

*Primary Examiner*—F. Barry Shay

*Attorney, Agent, or Firm*—Mason, Kolehmainen, Rathburn & Wyss

[57] ABSTRACT

A toy rocket includes a launching structure having a pivotally mounted, hollow cylindrical launching tube for holding a projectile before launching. A flexible air impact bulb is in communication by a flexible conduit with the launching tube and is adapted to withstand a sudden impact as by a user's hand or foot whereby the resulting compressed air is transmitted from the bulb through the launching tube. A projectile is provided and has a receiving recess positionable over the launching tube to receive the impact of the compressed air. The projectile is fabricated substantially of soft, porous or spongy material and the receiving recess is lined by a rigid impervious material of substantially higher density than the spongy material to add weight to the projectile.

4 Claims, 3 Drawing Figures

2
26
38
10
40
18
22
40
16
30
22
28
14
16
20
12
2

38
26
40
3
22
20
C
44
28
A
30
32
B
42
16
40
3
12
34

28
12
22

16
40
42
44
38
30
32
34
16
36
20
40
36
18
22

TOY ROCKET WITH PNEUMATIC LAUNCHER

BACKGROUND OF THE INVENTION

Cross Reference to Other Applications

This is a continuation-in-part of applicants' copending application Ser. No. 623,756 filed Oct. 20, 1975, now abandoned, entitled "Toy Rocket" and assigned to the assignee of the present invention.

Field of the Invention

This invention relates to toy rockets and particularly to a toy rocket which not only can be used indoors without causing damage but is safe for use by children.

Brief Description of the Prior Art

Various toy rockets have been provided throughout the years for use by both children and adults. Most of these rockets were designed for use out of doors, but there is no guarantee against damage or injury from use of the device either indoors or out. Most of these toy rockets have included projectiles which have at least portions of the exterior thereof fabricated of rigid materials which could harm the user, particularly a child, for example, if it would hit a child in the eye. This invention is directed to providing a new and improved, safe toy rocket.

SUMMARY OF THE INVENTION

In the exemplary embodiment of the present invention, the toy rocket includes a generally flat base for positioning on a supporting surface, such as a floor or the like. A hollow cylindrical launching tube is pivotally mounted on the flat base to hold the projectile at variable inclined positions before launching. A generally rectangular shaped flexible impact air bulb is positioned on top of the flat base and has a flexible conduit in communication with the launching tube to accommodate the pivotal movement thereof. The bulb is adapted to withstand a sudden impact as by a user's foot or hand whereby the resultant air is transmitted from the bulb through the launching tube. A projectile is provided with a receiving means positionable over the launching tube to receive the impact of the compressed air. The projectile is fabricated of soft, porous spongy material such as polyurethane foam for safety purposes. The inside of the receiving recess in the projectile is lined with a rigid impervious material of substantially higher density than the spongy material and is formed in a complementary shape with the outside of the launching tube so as to receive the full impact of the air from the bulb. The rigid lining is completely covered and enclosed by the porous spongy, substantially lightweight, material. The projectile is generally cylindrical, being tapered at the nose and having outwardly protruding longitudinal fins at the base thereof fabricated of the same soft, porous spongy material.

Other objects, features and advantages of the invention will be apparent from the following detailed description taken in connection with the accompanying drawings.

DESCRIPTION OF THE PREFERRED EMBODIMENT

Figure 2:
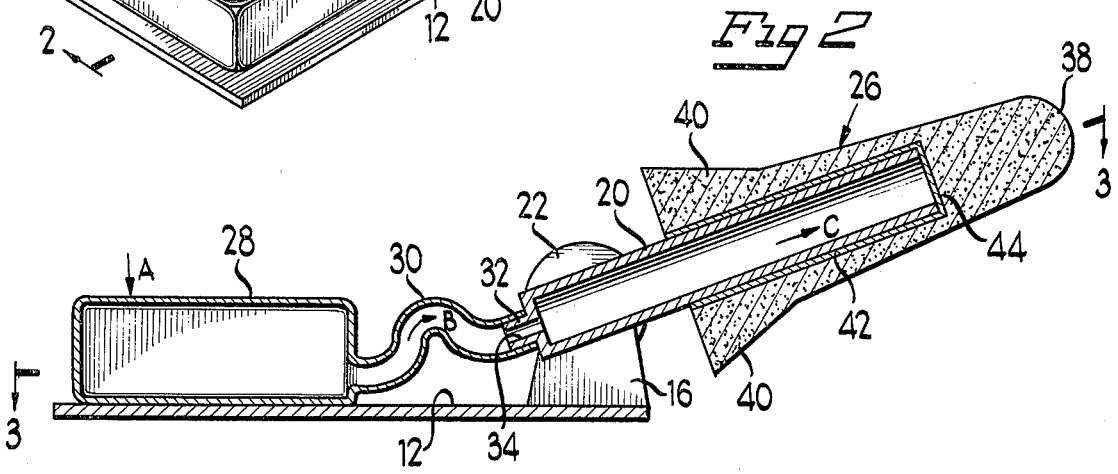
FIG. 2 is a vertical section, on an enlarged scale, taken generally along the line 2—2 of FIG. 1.
Figure 3:
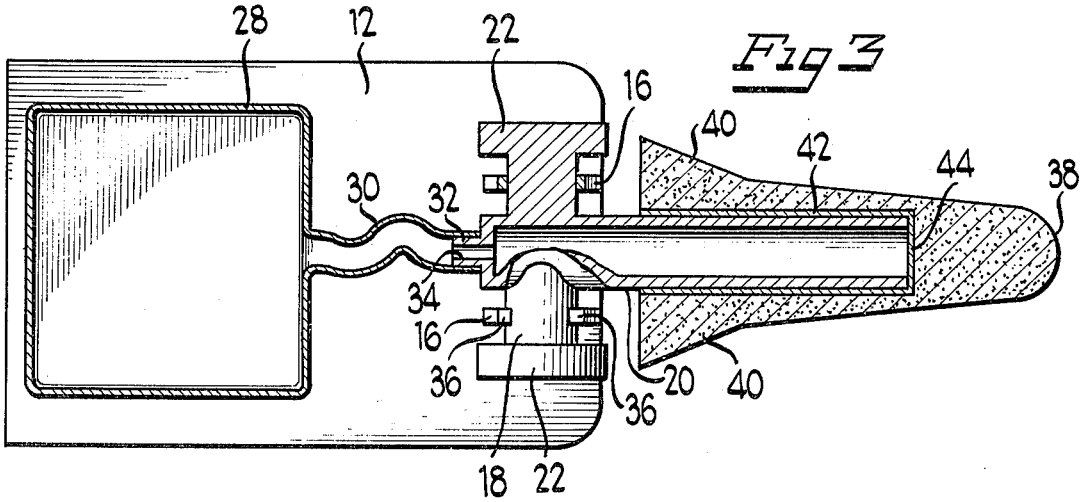
FIG. 3 is a horizontal section taken generally along the line 3—3 of FIG. 2.

Referring to the drawings in greater detail, the toy rocket, generally designated 10 (FIG. 1), includes a generally flat base 12 for positioning on a supporting surface, such as a floor, table or the like. The flat base has a mounting portion, generally designated 14, which includes a pair of upright flanges 16 for pivotally mounting a generally transverse support shaft 18. A launching tube 20 is secured to the shaft 18 and preferably is integrally formed therewith as shown in FIG. 3. A pair of generally enlarged flanges 22 on the ends of the shaft 18 act as thumbwheels to facilitate pivotal movement of the launching tube 20 to various inclined positions, one of which is shown in FIG. 2. The launching tube 20 mounts a projectile, generally designated 26, prior to launching as described below.

A generally rectangular, flexible air impact bulb 28 includes an integral conduit 30 extending generally toward the launching tube 20 for securement about a stem 32 at the base of the launching tube 20 so that air within the bulb is in communication, through a hole 34 in the stem, with the interior of the launching tube 20. The bulb is of a material adapted to withstand a sudden impact, as by a user's hand or foot, in the direction of arrow A (FIG. 2) whereby the resultant pressurized air is transmitted from the bulb 28 in the direction of arrow B (FIG. 2) through the launching tube in the direction of arrow C to impart accelerating forces to the projectile 26. The shaft 18 is snap fit between the tops 36 of the flanges 16 as best seen in FIG. 3. The top ends 36 of each of the flanges extend past the midpoint or largest diameter of the shaft 18 to maintain the shaft therein and frictionally hold the shaft to support the launching tube 20 in any desired inclined angle as set by the user through use of the thumbwheels 22.

Figure 1:
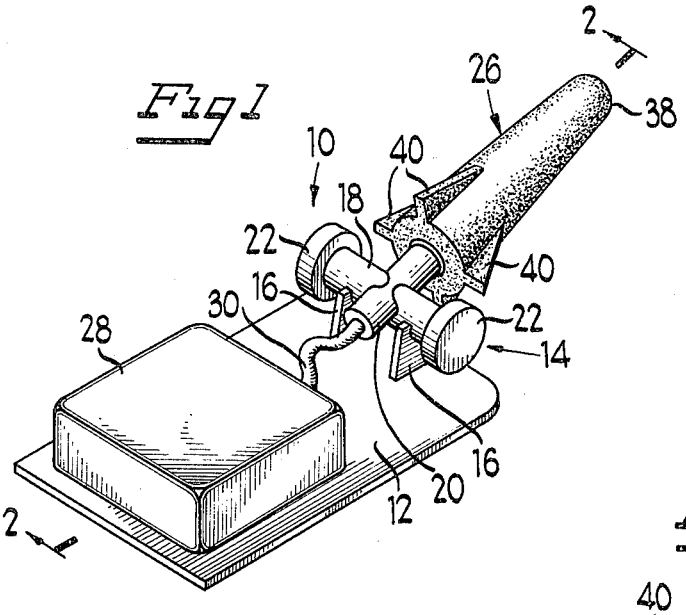
FIG. 1 is a perspective view of the toy rocket of the present invention.

The projectile for the toy rocket 10 of the present invention has a generally cylindrical external shape as best seen in FIG. 1 which tapers to a nose 38 at the front end thereof and includes four triangularly shaped wings 40 at the base thereof for stabilization during flight. The projectile 26 and the wings are integrally fabricated of a lightweight, soft flexible, spongy porous material such as polyurethane foam, or the like. The nature of the foam makes the projectile 26 extremely safe for use by children. However, to prevent the loss of air through the foam material, a receiving recess within the projectile 26 includes a generally cylindrical liner 42 having an interior end cap 44. This liner 42 and cap 44 is fabricated of rigid, air impervious material having a substantially higher density than the polyurethane foam material such as a plastic or the like, and is complementary in shape with the outside of the launching tube 20 to prevent leakage of air therebetween. As best seen in FIGS. 2 and 3, the liner 42 and cap 44 are completely surrounded by the soft flexible material of the projectile for added safety so as not to cause damage to property or injury to individuals. The liner 42 provides a hard smooth surface for receiving the air impact from the bulb 28 and transmitting the impact or force to the projectile for launching. The higher density and thus mass of the liner 42 and end cap 44 provides sufficient mass for the otherwise lightweight projectile 26 to sustain the projectile 26 through a longer flight than would otherwise be possible with the polyurethane foam alone. Once launched, the inertia of the projectile, including the weight of the liner 42, is sufficient to sustain better directional control and longer flight paths.

The foregoing detailed description has been given for clearness of understanding only and no unnecessary limitations should be understood therefrom as some modifications will be obvious to those skilled in the art.

We claim:

1. A toy rocket, comprising:

launching means including a base portion for positioning on a suitable supporting surface, a hollow cylindrical, elongated launching tube for holding a projectile before launching, said launching tube being pivotally mounted to the base portion by a trunion shaft formed integrally with said launching tube including at least one enlarged end providing a thumbwheel handle to facilitate manual pivoting of the launching tube relative to the base portion, means removably mounting said trunion shaft comprising an arcuate surface for engaging said shaft and providing a snap-fit therewith for frictionally maintaining the shaft therein at any predetermined angle and a generally rectangular, molded, flexible air impact bulb having a conduit in communication with said launching tube, said bulb being positioned on top of said base and adapted to withstand sudden impact by a user whereby the resultant compressed air is transmitted from the bulb through the launching tube; and a projectile having a receiving means therein positionable over said launching tube to receive the impact of said compressed air, the exterior of said projectile being generally cylindrical having integrally formed outwardly protruding longitudinal fins at one end thereof, and being fabricated of low density, soft, porous material, said receiving means comprising a cylindrical liner of rigid impervious, relatively higher density material secured to the interior of said projectile for adding mass to the projectile for flight and to prevent leakage of said compressed air therethrough, said liner having an internal diameter approximately equal to the outer diameter of said launching tube for mounting thereon.

2. The toy rocket of claim 1 wherein said conduit and air bulb are integrally formed.

3. A toy rocket, comprising:

launching means including a base, a hollow cylindrical launching tube removably secured and pivotally mounted to the base for holding a projectile before launching, said launching tube being formed integrally with a trunion shaft having at least one enlarged end thereon providing a thumbwheel to facilitate manual pivoting of the launching tube relative to the base, means removably mounting said shaft to the base comprising an arcuate surface for engaging said shaft and providing a snap-fit for frictionally maintaining the shaft therein at any predetermined angle, and a flexible air impact bulb in communication with said launching tube adapted to withstand a sudden impact by a user whereby the resultant compressed air is transmitted from the bulb to the launching tube; and a projectile having receiving means positionable over said launching tube to receive the impact of said compressed air, the entire exterior of said projectile being fabricated of lightweight flexible, porous material, said receiving means comprising a cylindrical, closed end liner of rigid impervious, relatively higher density material secured to the interior of said projectile for adding mass to the projectile for flight and to prevent leakage of said compressed air therethrough, said liner having an inner diameter approximately equal to the outer diameter of said launching tube for mounting thereon, said liner being shorter than said launching tube so that the closed end thereof provides a stop to prevent further movement of said projectile in one direction relative to said launching tube.

4. The toy rocket of claim 3 wherein said lightweight flexible, porous material is polyurethane foam.

* * * * *